US006119495A

United States Patent [19]

Loreti

[11] Patent Number: 6,119,495

[45] Date of Patent: Sep. 19, 2000

[54] PROGRAMMABLE CYLINDER LOCK, PROVIDED WITH MASTER KEYS

[76] Inventor: Alberto Loreti, Frazione Castello di Corno, I-02013 Antrodoco, Rieti, Italy

[21] Appl. No.: 09/035,782

[22] Filed: Mar. 6, 1998

[51] Int. Cl.[7] ..... E05B 35/10; E05B 27/00

[52] U.S. Cl. ..... 70/340; 70/495; 70/384

[58] Field of Search ..... 70/492, 495, 496, 70/340, 341, 342, 343, 382, 384, 383, 337–338, 339, 389

[56] References Cited

U.S. PATENT DOCUMENTS

| | | | |
|---|---|---|---|
| 3,999,413 | 12/1976 | Raymond et al. | 70/384 |
| 4,015,458 | 4/1977 | Mercurio | 70/495 |
| 4,028,917 | 6/1977 | Schlage | 70/389 |
| 4,376,382 | 3/1983 | Raymond et al. | 70/384 |
| 4,712,399 | 12/1987 | Mattossovich | 70/383 |
| 4,729,231 | 3/1988 | Wu | 70/384 |
| 4,741,188 | 5/1988 | Smith | 70/383 |
| 4,912,953 | 4/1990 | Wobig . | |
| 4,942,749 | 7/1990 | Rabinow | 70/495 |
| 4,966,021 | 10/1990 | Boag | 70/383 |
| 5,000,019 | 3/1991 | Foster . | |
| 5,079,936 | 1/1992 | Stefanek | 70/493 |
| 5,826,451 | 10/1998 | Cook | 70/495 |

FOREIGN PATENT DOCUMENTS

| | | | |
|---|---|---|---|
| 0 226 252 A2 | 6/1987 | European Pat. Off. . | |
| 2410718 | 8/1979 | France | 70/495 |
| 2055948 | 3/1981 | United Kingdom | 70/495 |
| 2 298 454 | 9/1996 | United Kingdom . | |

*Primary Examiner*—Darnell M. Boucher
*Attorney, Agent, or Firm*—Young & Thompson

[57] ABSTRACT

A programmable cylinder lock that is operable with a first key and a first master key having a different shape than the first key, and that is programmable so that the lock is no longer operable with the first key or the first master key. The reprogrammed lock is operable with a second key having a shape different from the first key and with a second master key having a shape different from the first master key.

6 Claims, 9 Drawing Sheets

PROGRAMMABLE CYLINDER LOCK, PROVIDED WITH MASTER KEYS

BACKGROUND OF THE INVENTION

This invention refers to a programmable cylinder lock which comprises devices intended to allow, through a change operation, adapting the lock to a key different from a key to which the lock was formerly adapted.

Through the present description, the word "lock" is intended to designate, in addition to the usual locks for doors or leaves, also any kind of special locks, such as padlocks and others.

Various embodiments of cylinder locks suitable to behave in the above stated manner are known, and among them there is, in particular, the lock according to the U.S. Pat. No. 4,712,399. In the following, through the present description reference is made to programming mechanisms substantially conforming the mechanisms of said United States Patent, but it should be realized that the present invention is not limited to the use of such mechanisms, and it may also be applied to cylinder locks using different programming mechanisms.

There are also known masterizable locks which, thanks to the use of locking pins subdivided in two or more sections, may be operated both by an individual key singularly adapted to a specific lock, and by one or more other keys, called master keys, which may also operate other locks, each one of them being also operable by an individual key. This allows to establish within a group of locks a hierarchy on two or more levels, whereby each lock may be operated by its own key, which cannot operate the other locks of the group, as well as by a master key, which is capable of operating all the locks of the group, and possibly also by one or more other master keys of lower level, each one adapted to operate all the locks of a specific sub-group, but not the locks of the other sub-groups being part of the whole lock group taken in consideration.

However, in the known embodiments, the programmable cylinder locks cannot be provided with master keys, whereas the cylinder locks provided with master keys are not suitable for being programmed.

SUMMARY OF THE INVENTION

A first object of the present invention is to provide a programmable cylinder lock which, in addition, may be provided with master keys. Another object of the invention is to provide such a programmable cylinder lock provided with master keys, which may be industrially manufactured in a profitable way. Still another object of the invention is to provide such a programmable cylinder lock provided with master keys, which should have particular features of mechanical strength and resistance against effraction attempts. A further object of the invention is to provide such a programmable cylinder lock provided with master keys, wherein the programming steps should be easy, sure and quick to be made by the user. Finally, it is an object of the invention to provide such a programmable cylinder lock provided with master keys, wherein the programming operations should be allowed only to those who are in possession of a special key.

The first object of the invention is achieved by means of a programmable cylinder lock, comprising a stator, a rotor, and a mechanism intended to allow, through a change operation, adapting the lock to a key different from a key to which the lock itself was formerly adapted, characterized in that the lock further comprises at least one locking pin or counter-pin which is subdivided in two or more sections, and is suitable for being displaced to an opening position by action of two or more keys having different shapes.

Preferably the locking pins or counter-pins subdivided in two or more sections are more than one in number.

Therefore, the invention is characterized, among other things, by the combination, in a lock, of different mechanisms, per se individually known in the art, but which have been always used the one or the other, and not in their combination.

Thanks to these features, the lock may be actuated by two or more keys which differ from each other only in the height of the tooth or teeth intended to act onto the locking pin or locking pins subdivided in two or more sections. Therefore, by suitably choosing the positions in which the breaks of the locking pin or locking pins subdivided in two or more sections are arranged, it is possible to provide groups of locks, wherein each lock may be actuated only by its individual key and by one or more master keys, possibly ordered on more than one level. Moreover, thanks to the presence of the programming mechanism, it is possible to foresee several sets of individual keys and master keys, and the locks may be adapted for being actuated by the keys pertaining to the one or the other of said key sets.

Preferably, the lock further comprises one or more locking pins or counter-pins which are not subdivided into sections. Such locking pins do not participate to programming the lock nor to providing the master keys, but they contribute to the safety of the lock by increasing the number of combinations which may be realized, and because said locking pins which are not subdivided may be manufactured and mounted in a more economical way, their presence allows to render the lock industrially more profitable.

It is advantageous that the programming mechanisms, the locking pins subdivided in two or more sections, and the possible pins which are not subdivided into sections, are aggregated into groups. This allows to rationalize and organize in the best way the manufacturing and mounting of the lock. However, the various groups or the single devices may be arranged in any manner within the lock.

Advantageously the lock comprises a stator, a cavity provided in said stator, a rotor inserted in said stator cavity, and a keyhole provided in said rotor, and it is characterized in that the programming mechanism includes, in said stator, at least one longitudinally extending groove formed in said cavity, a possible set of stator seats and locking counter-pins and springs housed in said stator seats, and includes, in said rotor: a set of first seats which intersect said keyhole, and a set of second seats parallel to said first seats, as well as a first and a second slot, perpendicular to said seats and parallel to the rotor axis, a set of key followers inserted and longitudinally and transversally movable within said first rotor seats in order to co-operate with the teeth of a key inserted in said keyhole, each key follower having on one edge a number of projections, having on the opposite edge a slidable joint member and having an associated spring; a set of locking pins slidably inserted in said second rotor seats, corresponding to said locking counter-pins of the stator and having a number of first recesses facing said projections of the key followers, and one or more second recesses directed opposite said key followers; a stop bar inserted in said first orthogonal rotor slit, having projections facing said second recesses of the locking pins and a uninterrupted projection extending in the opposite direction, suitable for co-operating with a stator groove; first springs associated with said stop bar in order to push the same outwardly; a translation bar, inserted in said second orthogonal rotor slit, having slidable joint members suitable for engaging said slidable joint members of the key followers, and a uninterrupted projection extending in the opposite direction, suitable for co-operating with a stator groove; and second springs associated with said translation bar in order to push the same outwardly; said parts being mutually coordinated in such a way, that said projections of the stop bar engage said second recesses of the locking pins when the uninterrupted projection of the stop bar does not register with a stator groove, and disengage therefrom when a stator groove allows the stop bar to displace outwardly under action of said first springs, whereas the projections of said key followers engage corresponding recesses of the locking pins when the uninterrupted projection of the translation bar does not register with a stator groove, and disengage therefrom when a stator groove allows the translation bar to displace outwardly under action of said second springs by dragging the key followers due to the respective slidable joint members; whereby said translation bar, when it registers with a stator groove, is displaced outwardly by dragging the key followers, these latter are disengaged from the locking pins and then, in this position, they allow replacing the key, thereby differently programming the lock.

It is advantageous that the lock further includes an elastic fork-shaped ring housed in said stator and co-operating with said rotor in order to limit, during the change operation, the free section of said keyhole. In this manner, by suitably shaping the keys, it is possible to obtain that only special privileged keys are allowed to be inserted and taken out during the change operation, whereby only those who are in possession of said privileged keys are allowed to modify the programming of the lock.

BRIEF DESCRIPTION OF THE DRAWINGS

These and other features, objects and advantages of the subject of the present invention will appear more clearly from the following description of an embodiment, having the character of a non-limiting example, with reference to the appended drawings, wherein.

DESCRIPTION OF THE PREFERRED EMBODIMENT

Figure 12:
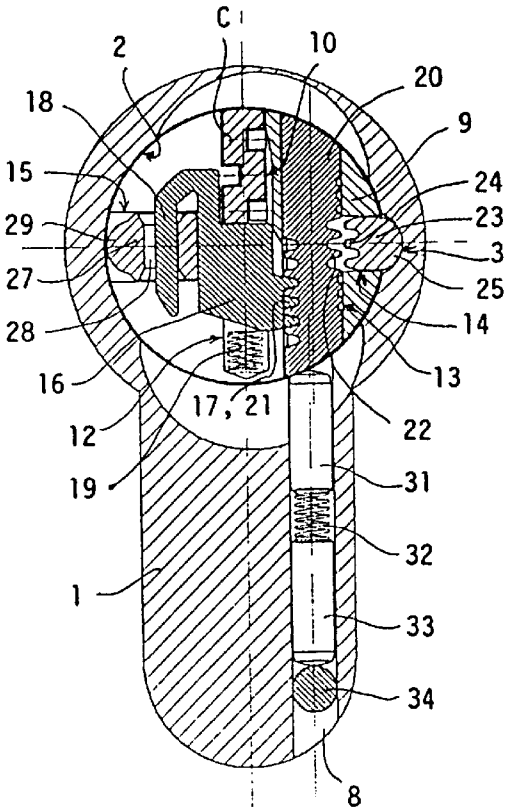
FIGS. 10, 11 and 12 show sections taken along cross vertical planes defined by lines X—X, XI—XI and XII—XII, respectively, of FIG. 8.
Figure 11:
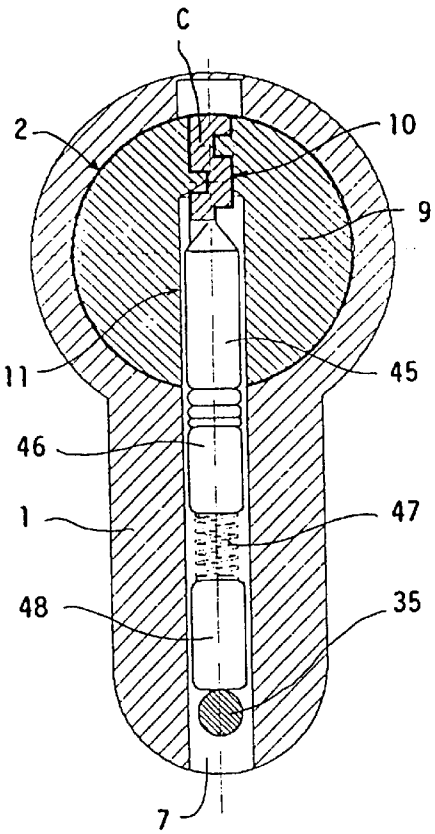
Figure 10:
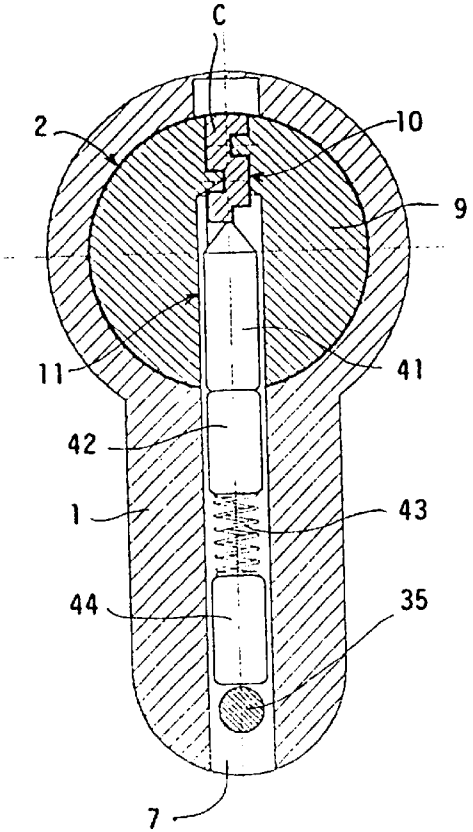
Figure 13:
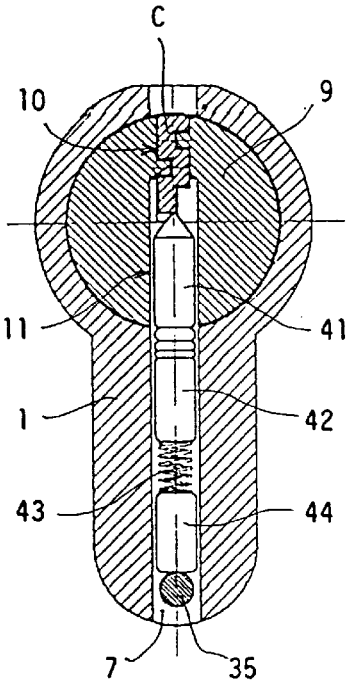
FIGS. 13 to 16 show how the lock according to the invention may be operated by two different keys (individual key and master key)

With reference to FIGS. 1, 2 and 8 to 12, a lock according to the invention comprises a stator 1 which, in the embodiment shown, has a circular cross section with elongated bottom projection, namely a shape widely used in this kind of locks. However, it is to be realized that the shape of the stator is not a critical one, whereby the stator may be shaped in any manner in order to correspond to any specific need of installation. Stator 1 has a cylindrical seat 2 for a rotor 9, and along said seat extends, at least in the region of the programming mechanism, a lateral longitudinal groove 3 (FIG. 12). In this embodiment there is a single groove 3,extending perpendicularly to the holes for the locking counter-pins, which are discussed later on, but this is not the only possible arrangement, and in different embodiments two or more grooves may be foreseen, arranged according to different angles. Moreover, in the shown embodiment stator 1 has a recess 4 intended to house a ring 5 with a web 6 which, coupled with the rotor 9, forms the operating member of the lock. However, of course, in other embodiments the web may be replaced by any other operating member, such as an eccentric shaft of a key projecting at rear from rotor 9. Stator 1 further has vertical holes 7 and 8 intended to house the locking counter-pins of the lock, which are discussed later on.

The rotor 9 is cylindrical, it has a keyhole for inserting a flat key C and is housed within the stator seat 2, wherein it is retained by elastic rings 37 and 38, as well as by an elastic fork-shaped ring 39, which is discussed later on. In the shown example, at the time of its installation into stator 1, the rotor 9 engages by means of a coupling member 36 the ring 5 having the web 8, in order to actuate the same. A rear spacing plug 40 closes the stator seat 2.

Within the stator 1 and rotor 9 there are mounted three types of mechanisms, which will now be described with reference to FIGS. 5 to 7 and FIGS. 10 to 12.

The mechanism of the I type (FIGS. 5 and 10) is a mechanism with locking pins and locking counter-pins of a conventional kind, and each unit of this mechanism comprises a locking pin 41 inserted in a hole 11 of rotor 9, which hole intersects the keyhole 10 for the flat key C, as well as a locking counter-pin 42, a spring 43 and a rest block 44, all inserted in a hole 7 of stator 1 and retained in their whole, along with other components, by a retainment bar 35 inserted in a corresponding longitudinal bore of the stator. This mechanism is per se well known, and it allows rotating the rotor 9 with respect to stator 1 only when the height of the tooth of key C which acts upon the locking pin 41 is such that the separation surface between locking pin 41 and locking counter-pin 42 is brought to register with the cylindrical coupling surface between stator 1 and rotor 9 (line P in FIG. 5). In any other position the locking pin 41 or the locking counter-pin 42 extends through said coupling surface and forms a latch which prevents the rotation of rotor 9.

It is to be remarked that this conventional mechanism of the I type contributes to the safety of the lock because it increases the number of possible combinations in the codification of the key, and it contributes to the lock resistance by providing a latch member, but it does not contribute to the capability of the lock to be programmed, nor to the possibility of providing the lock with master keys. It is of advantage to make use of a number of such mechanisms because of their simple manufacture and installation, but a lock according to the invention could also be realized without any use of mechanisms of this I type, whereas, of course, it could not include mechanisms of the I type only.

The mechanism of the II type (FIGS. 6 and 11) is a typical mechanism of the locks with master keys. It is installed in the same way described for the mechanism of the I type, but it differs therefrom in that the locking pin 45 is subdivided in two or more sections in the region near the separation surface with respect to the locking counter-pin 46. Due to this feature, the mechanism of the II type allows rotating the rotor 9 with respect to stator 1 when the height of the tooth of key C which acts upon the locking pin 45 is such that any one of the separation surfaces between locking pin 45 and locking counter-pin 46, or between sections of the locking pin 45, is brought to register with the cylindrical coupling surface between stator 1 and rotor 9 (line P in FIG. 6). In any other position a section of the locking pin 45 or the locking counter-pin 46 extends through said coupling surface and forms a latch which prevents the rotation of rotor 9. Therefore, in order to assume a position allowing opening the lock, this mechanism may accept a number of different heights of the corresponding tooth of key C, equal to the number of sections forming the locking pin 45.

Figure 14:
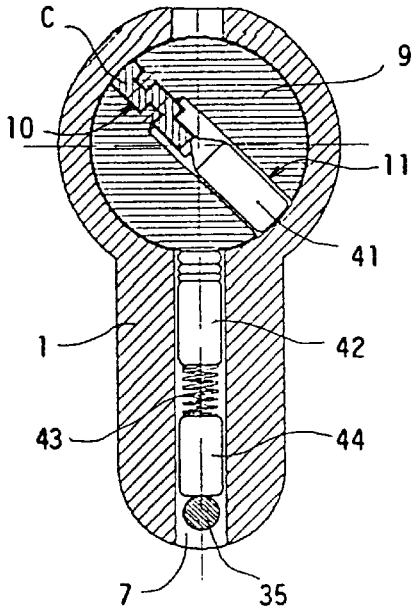
Figure 15:
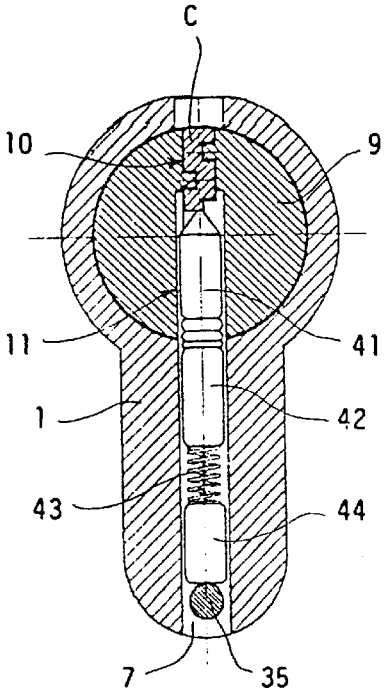
Figure 16:
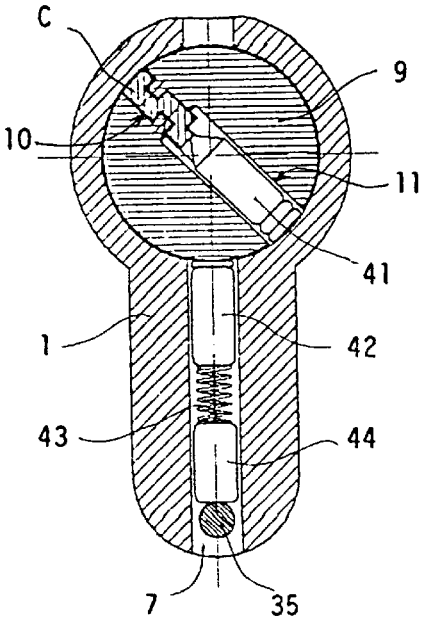
Figure 19:
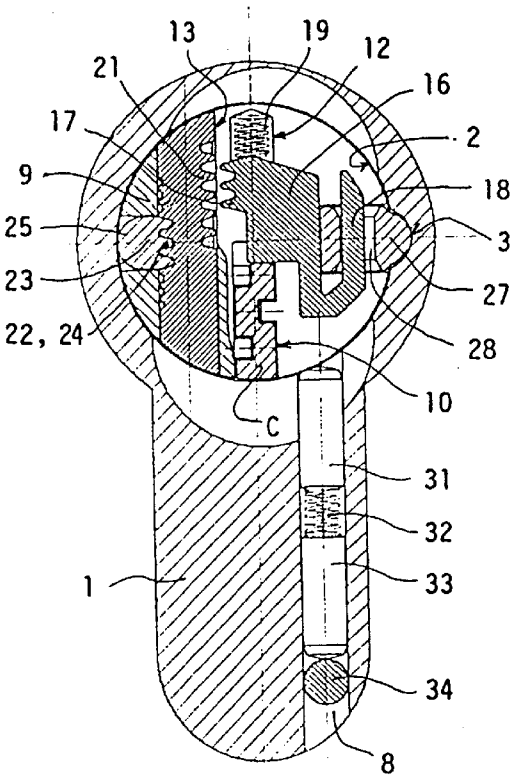
FIGS. 17 to 22 show how the lock according to the invention may be programmed in order to be operated by two different keys.
Figure 18:
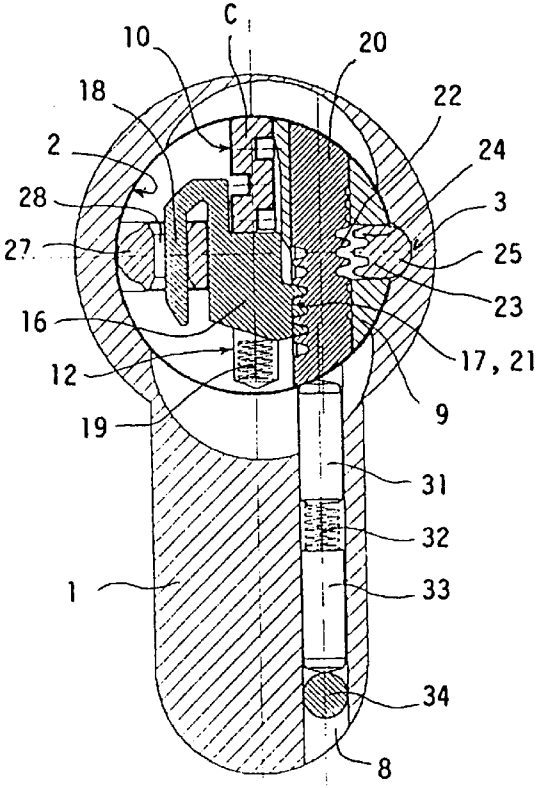
Figure 17:
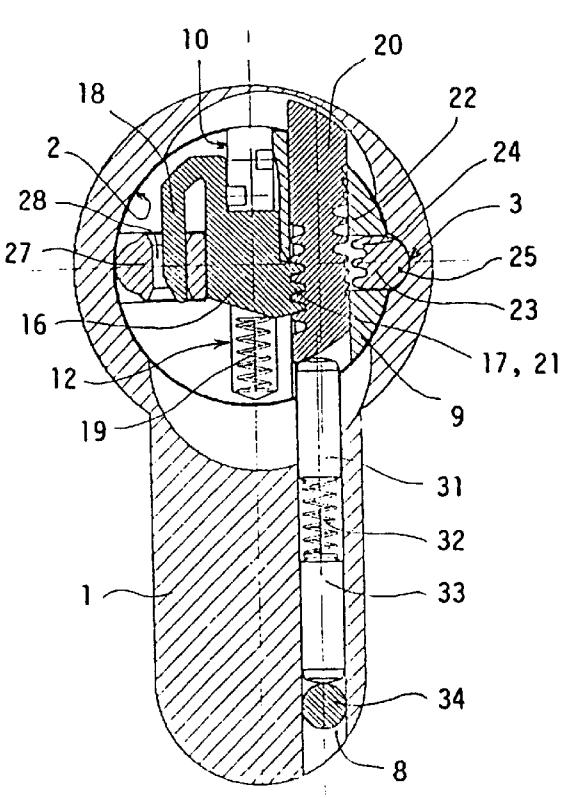
Figure 22:
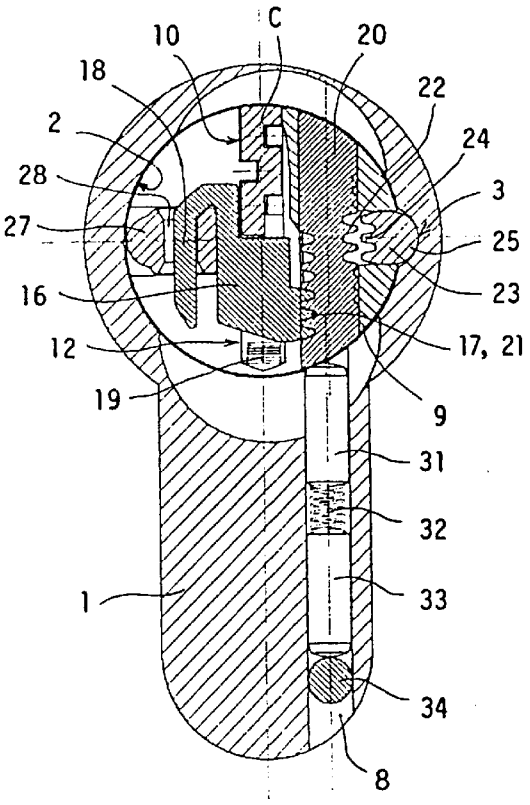
Figure 21:
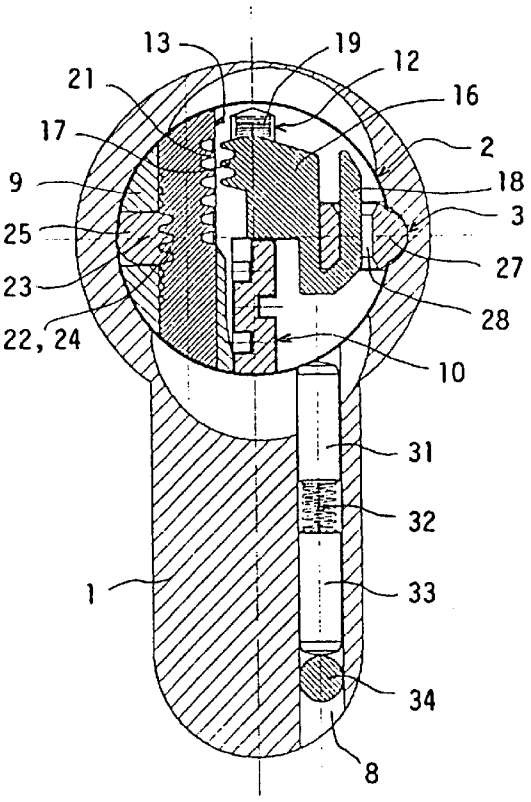
Figure 20:
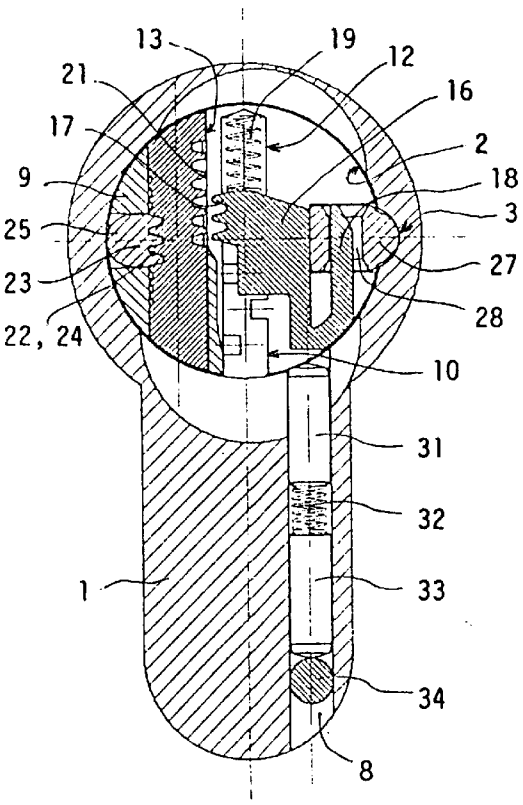

The behavior of this mechanism of the II type is clarified by FIGS. 13 to 16, wherein the locking pin 45 is formed by four sections. According to FIG. 13, the height of the tooth of key C which corresponds to the mechanism in question is such that the separation surface between the first and second sections of the locking pin 45 is brought to register with the cylindrical coupling surface between stator 1 and rotor 9. Therefore, rotor 9 is free to rotate as shown by FIG. 14; only the first section of the locking pin 45 rotates along with the rotor, whereas all remaining sections of this locking pin remain unmoved along with the locking counter-pin 46. On the other hand, according to FIG. 15 the height of the tooth of key C which corresponds to the mechanism in question is such that the separation surface between the third and fourth sections of the locking pin 45 is brought to register with the cylindrical coupling surface between stator 1 and rotor 9. Therefore, rotor 9 is free to rotate as shown by FIG. 16; the first three sections of the locking pin 45 rotate along with the rotor, whereas the remaining fourth section of this locking pin remains unmoved along with the locking counter-pin 46. Of course, according to this example there are two other tooth heights of the key C which allow rotating the rotor.

Therefore, by suitably choosing the number and the length of the various sections forming the locking pin of each mechanism of the II type, it is possible to provide master keys on one or more levels, capable of operating a certain number of locks of a group, each one of these locks being also operable by an individual key which, on its turn, is not capable to operate the other locks of the group.

Particularly, in a group of locks subdivided in a number of sub-groups, it is possible to provide a master key of top level, which is capable of operating all the locks of the whole group, and a number of master keys of lower level, each one of these master keys of lower level being capable of operating all the locks of the corresponding sub-group, but not the locks of the other sub-groups. Such a hierarchy may also be extended to more than two levels of master keys.

It is the mechanism of the II type which confers to the lock the possibility of providing master keys, and therefore in the lock according to the invention the presence of at least one mechanism of the II type is needed, but in the practice it is preferred that the number of such mechanisms be more than one.

In describing the mechanism of the II type it has been said that the locking pins 45 are subdivided in two or more sections. It is to be noted that the same behavior is obtained when the subdivision in several sections is applied to the locking counter-pins. In other words, the additional sections provided may be considered, indifferently, as pertaining to the locking pins 45 or to the locking counter-pins 46.

In addition, a lock according to the invention should include a programming mechanism, such as the mechanism of the III type described in the following as a non-limiting example.

The mechanism of the III type (FIGS. 7 and 12) is a programming mechanism which, in this embodiment, substantially conforms the programming mechanism described in the U.S. Pat. No. 4,712,399. In order to receive this mechanism, the rotor comprises a set of first seats 12 (FIGS. 8 and 9) which intersect the keyhole 10 for the flat key C, and a set of second seats 13 parallel to the first seats, as well as a first slit 14 and a second slit 15 which are orthogonal to said seats and parallel to the rotor axis. A key follower 16 is inserted, longitudinally and transversally movable, in one of said first rotor seats 12, in order to co-operate with the teeth of a key C inserted in said keyhole 10. The key follower 16 is provided on one edge with projections 17 and on the opposite edge with a slidable joint member 18, and it is associated with a spring 19 which pushes it upwards (in the shown position). A locking pin 20 is slidably inserted in one of said second seats 13 and it is provided with a number of first recesses facing said projections 17 of the key follower 16, as well as with one or more second recesses directed opposite said key follower 16. A stop bar 23 is inserted in said first orthogonal rotor slit 14, and it is provided with projections 24 facing said second recesses 22 of the locking pins 20, as well as with a uninterrupted projection 25 extending towards the opposite side and capable of co-operating with said stator groove 3. The stop bar 23 is associated with springs 26 which push the same outwards. A translation bar 27 is inserted in said second orthogonal rotor slit 15 and it is provided with slidable coupling members 28 suitable for engaging said slidable coupling members 18 of the key followers 16, as well as with a uninterrupted projection 29 extending towards the opposite side and suitable for co-operating with said stator groove 3. The translation bar 27 is associated with springs 30 which push the same outwards.

A locking counter-pin 31 may be inserted in the stator hole 8 in order to co-operate with the locking pin 20; it is pushed by a spring 32 resting by means of a block 33 against a retainment bar 34 inserted in a corresponding stator bore. Said locking counter-pins may be foreseen in order to give the lock more resistance, however they are not unavoidable, and the task of blocking the rotor may also be conferred to the blocking pins 20 only; therefore the blocking counter-pins 31, the corresponding springs 32, the blocks 33 and the retainment bar 34 may also be omitted in the lock according to the invention.

With reference to FIGS. 17 to 22, the operation of the programming mechanism is as follows.

In the absence of the key (FIG. 17) or in the case that a wrong key is inserted, the locking pins 20 and the locking counter-pins 31 (these latter if they are provided for) traverse the coupling surface between stator 1 and rotor 9, and they prevent the movement of the rotor. The locking pins 20 are solid with the key followers 16 due to the engagement between projections 17 and recesses 21. Under action of the springs 26, the stop bar 23 is inserted with its projection 25 in the stator groove 3, and therefore the recesses 22 and the projections 24 are disengaged, and the displacement of the locking pins 20, along with the corresponding key followers 16, when a key is inserted or taken out, is free. If the correct key is inserted (FIG. 18), the separation surface between the ends of locking pins 20 and locking counter-pins 31 are brought to register with the coupling surface between stator 1 and rotor 9, and therefore this latter may be rotated by 360° in order to operate the lock. At the end of this rotation, all components take again their start position, and the key may be taken out.

If, on the contrary, rotor 9 is rotated by 180° to a change position (FIG. 19), the projection 29 of the translation bar 27, under action of the springs 30, engages the stator groove 3, and the slidable joint members 18 and 28, mutually engaged, displace in transversal direction the key followers 16 and disengage the projections 17 from the recesses 21. On the other hand the stop bar 23, which does no more engage groove 3, has caused the projections 24 to engage the recesses 22, thus blocking in their positions the locking pins 20. If in this position it is possible to take out the key C (as explicated later on), all key followers 16 are displaced by the springs 19 to the end of their strokes (FIG. 20) and the lock has lost its programmation.

Then, by inserting a new key (FIG. 21), the key followers 16 take a programmation position corresponding to this new key. By rotating again the rotor by 180° the lock reverts to its start position, but it is now programmed for the new key.

Of course, in order that all this be possible, it is needed that the new key be compatible with the mechanisms of the I type (if they are present in the lock) and with the mechanisms of the II type, which mechanisms are not programmable and cannot be modified.

In general, it is not advisable that any person in possession of a key be allowed to modify the programming of the lock. For this reason it is foreseen that a normal key cannot be taken out from the lock in the change position rotated by 180°, and that only a key having peculiar features may be taken out in this position and, therefore, is capable of modifying the programming of the lock.

To this purpose there is provided the elastic fork-shaped ring 39, intended to be engaged in a peripheral groove 47 hollowed in rotor 9 near its outer end, which ring, when rotor 9 is inserted into the cavity 2 of rotor 1, engages a corresponding inner peripheral groove 48 hollowed in cavity 2, and remains fixed therein when the rotor is rotated. The elastic fork-shaped ring 39 is so shaped that it interferes with the keyhole 10 for the insertion of a key, when rotor 9 has been rotated from the start position. A corresponding notch T is provided in key C near its handle, whereby the key remains free to rotate despite the presence of the elastic fork-shaped ring 39, but the engagement of this latter with the notch T prevents the key C from being taken out when it has undergone a rotation by 180°.

Figure 1:
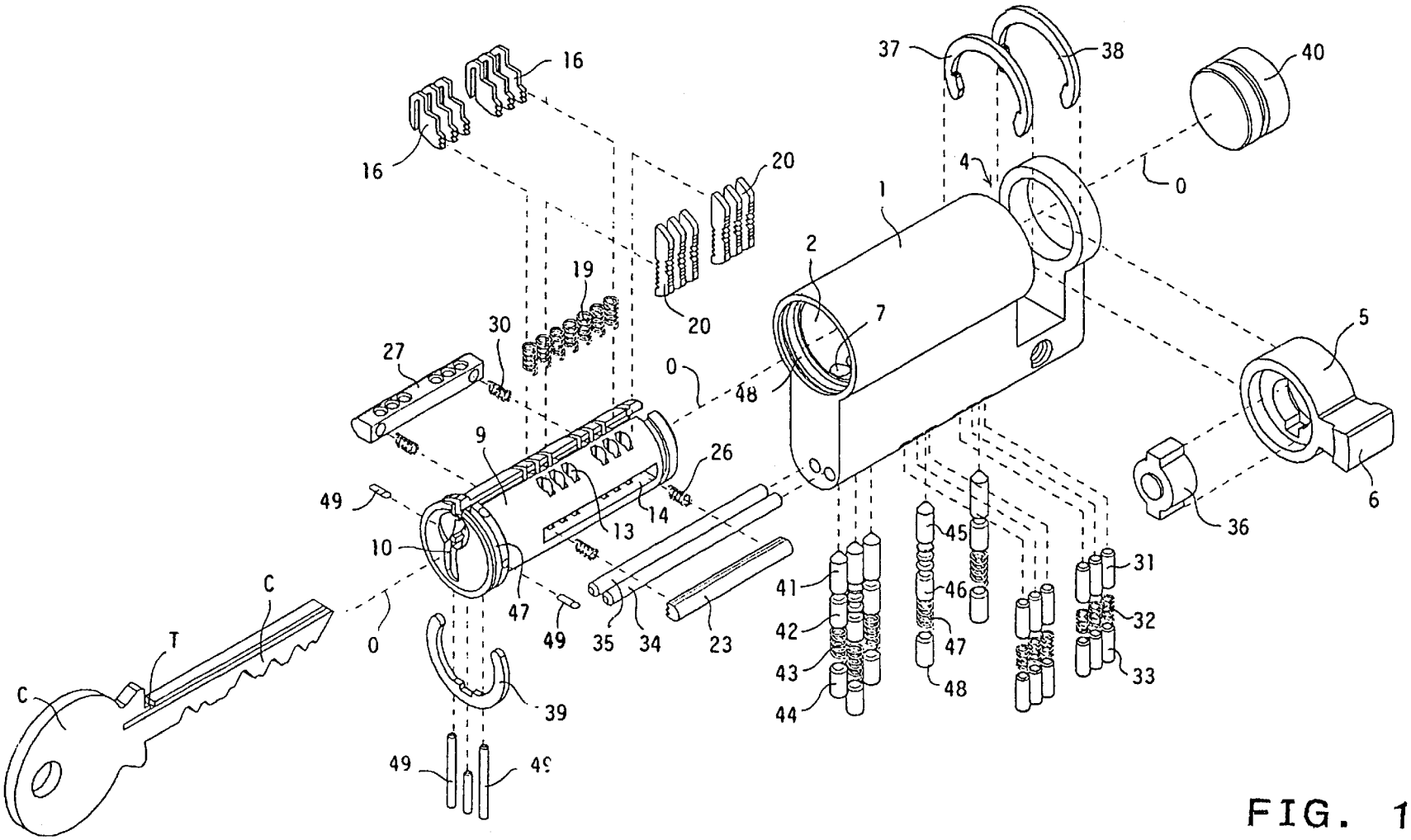
FIG. 1 shows an exploded view in axonometric perspective of the parts composing the lock according to the invention.
Figure 2:
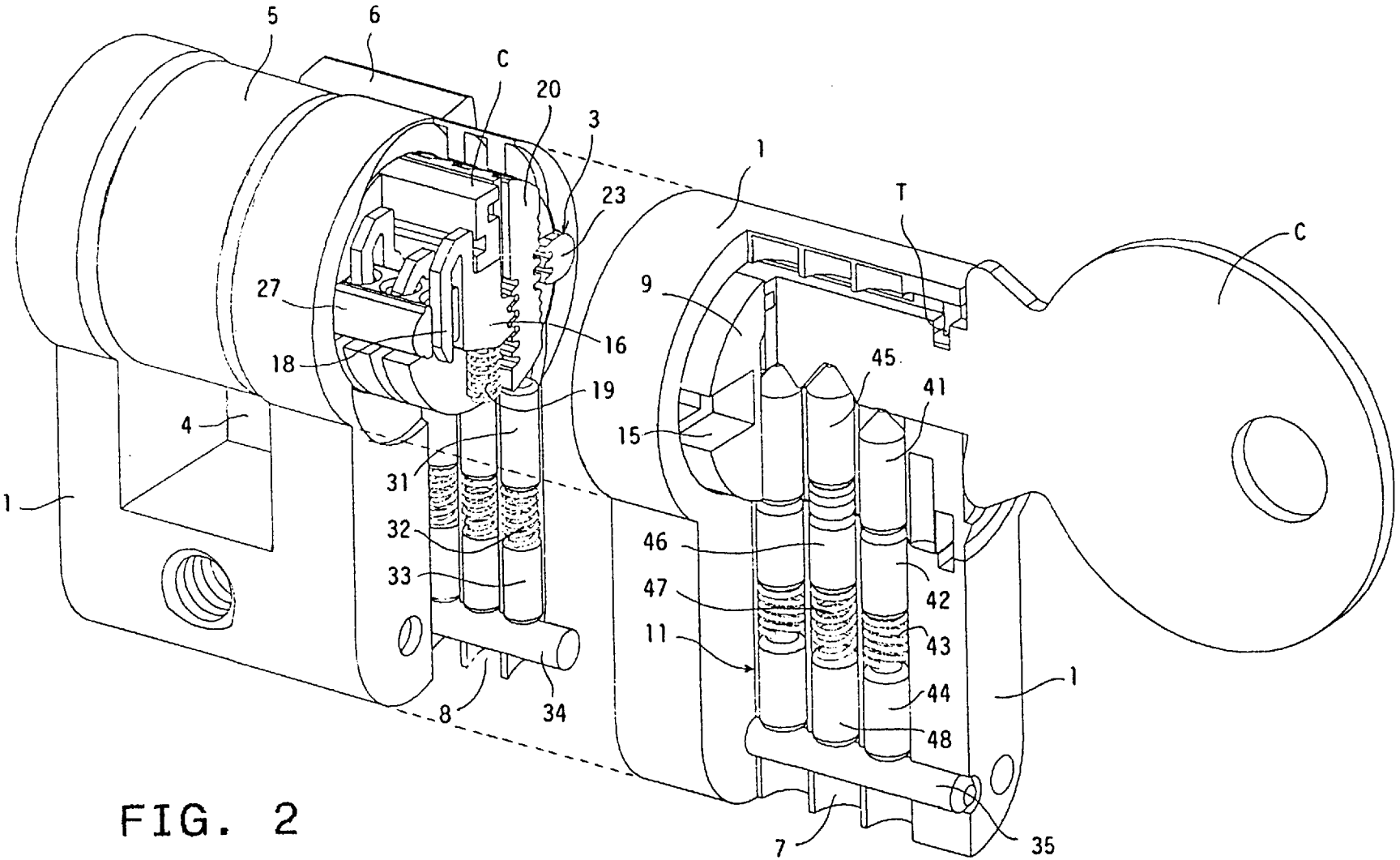
FIG. 2 shows the lock in axonometric perspective, with a break and with some outer portions sectioned in order to show some inner parts.
Figure 3:
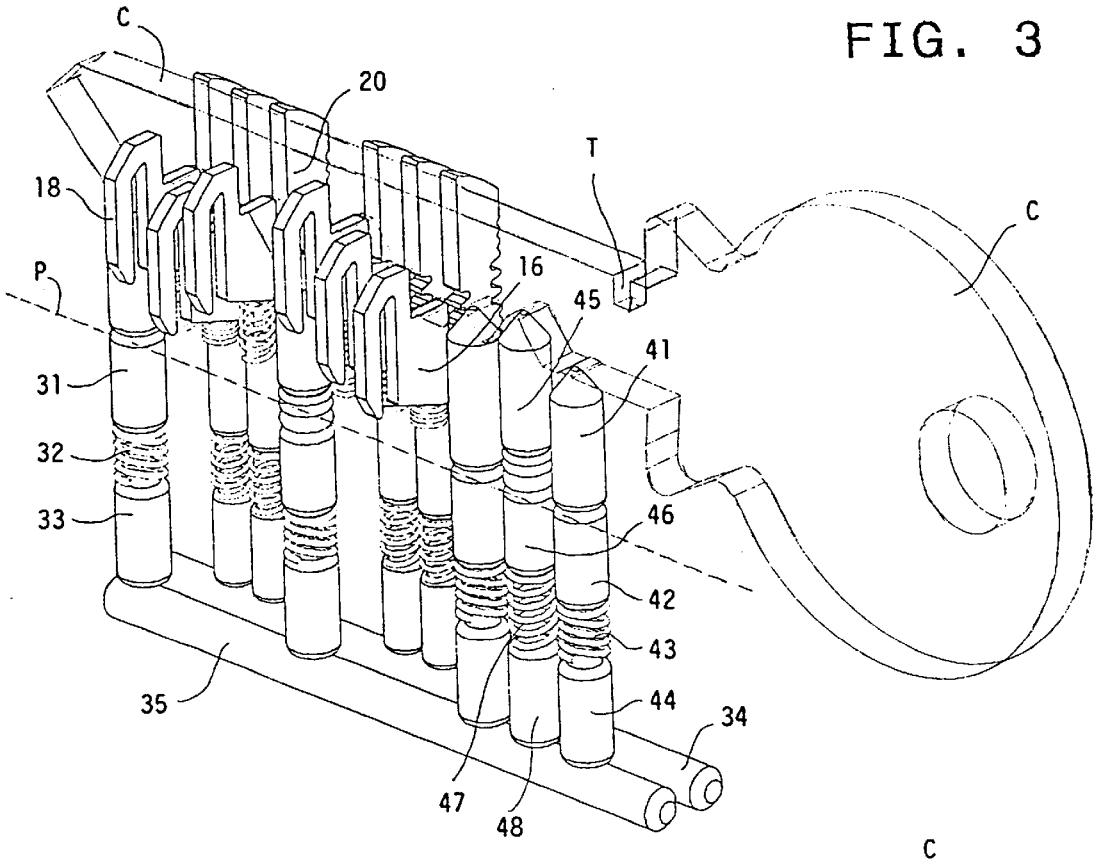
FIGS. 3 and 4 are axonometric views of the lock inner components only, viewed from the left side and from the right side, respectively.
Figure 4:
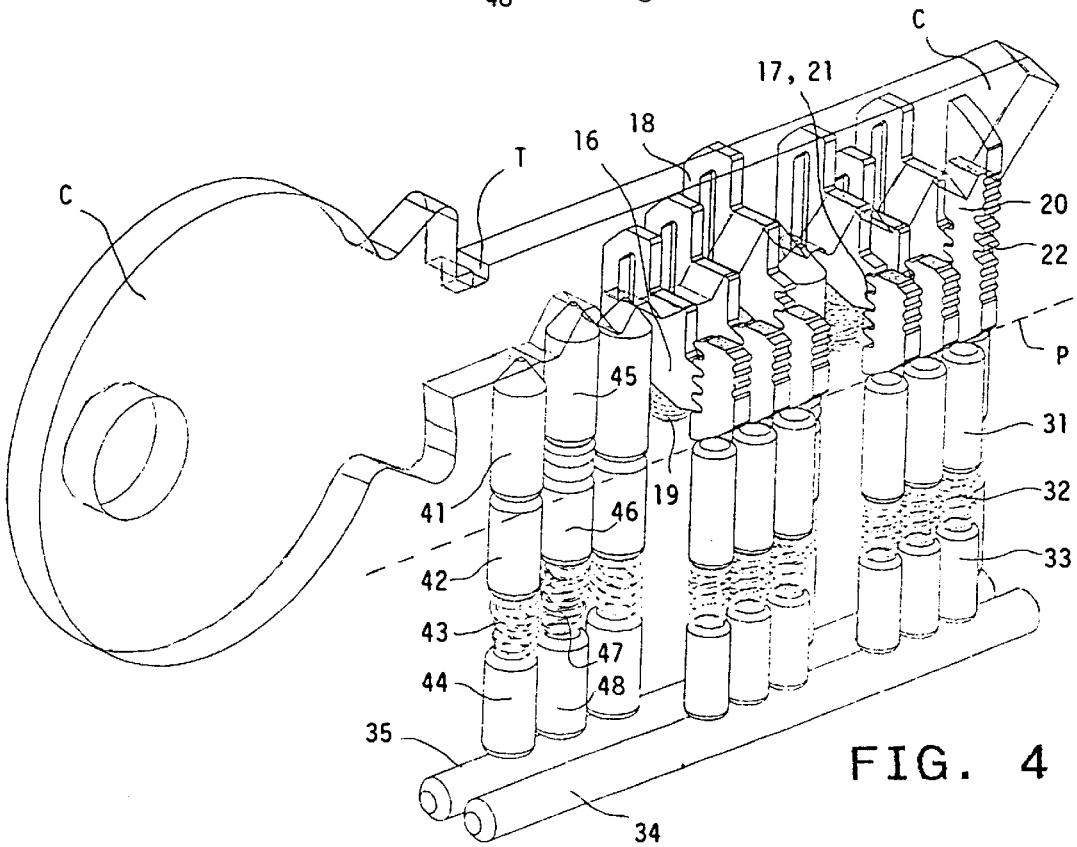
Figure 5:
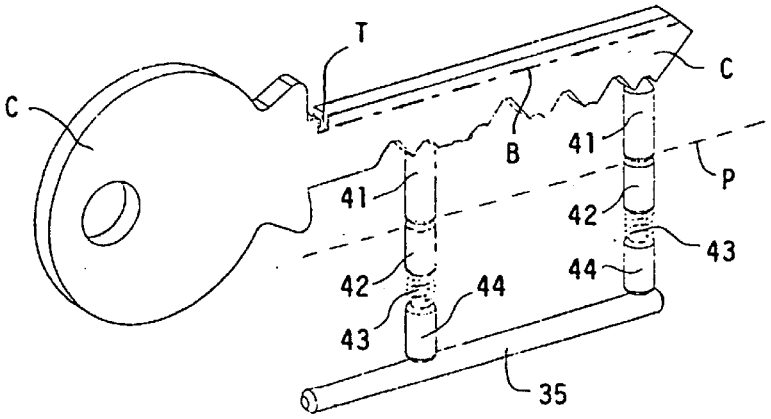
FIGS. 5, 6 and 7 are axonometric perspective views of three particular kinds of mechanisms included in the lock.
Figure 6:
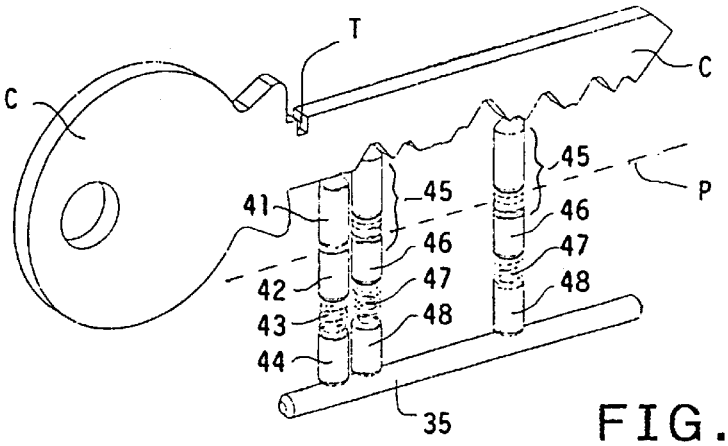
Figure 7:
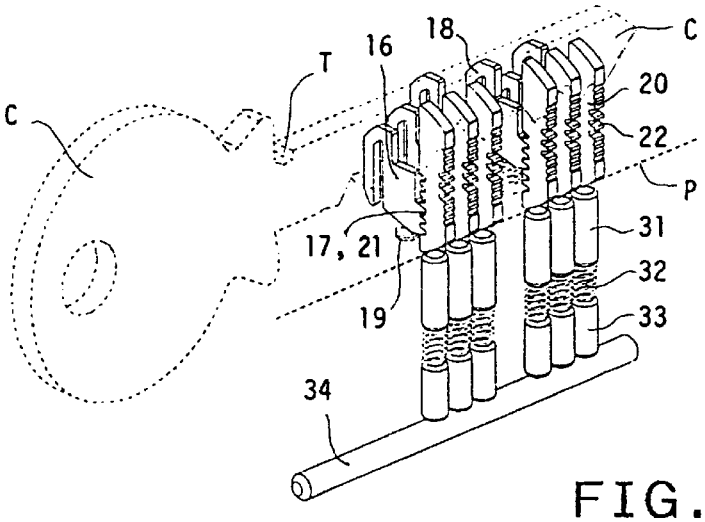
Figure 8:
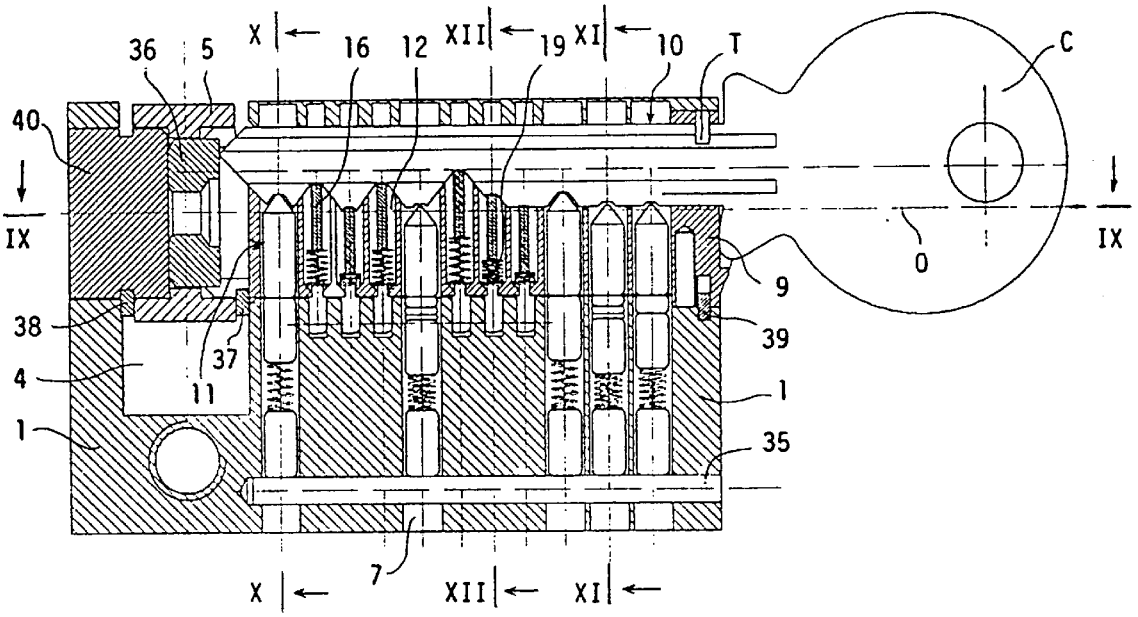
FIG. 8 shows a cross section taken along the central, longitudinal, vertical plane of the lock, namely along line VIII—VIII of FIG. 9.
Figure 9:
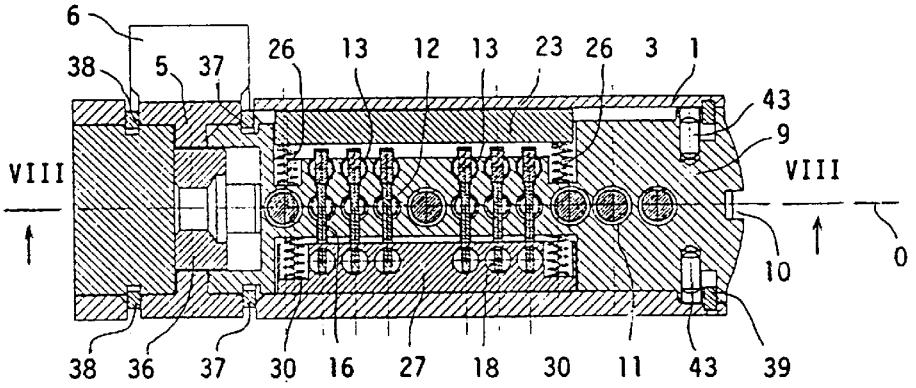
FIG. 9 shows a section taken along a horizontal plane defined by line IX—IX of FIG. 8.

The key intended to allow modifying the programming has a reduced height, for example as shown by an interrupted line B in FIG. 5. Such a key is not retained by the elastic fork-shaped ring 39, and therefore it may be taken out the rotor 9 after a rotation of 180°, and then another key, having a different codification but correspondingly reduced in height, allows establishing the new programming of the lock.

The specific shape which allows modifying the programming of the lock may be provided in all master keys, or only in some of them, or even only in a special master key, the only key being capable of modifying the programming of the lock.

As it may be remarked, despite the unavoidable complexity of a lock of the desired kind, the industrial manufacture of the lock according to the invention is relatively easy and expedient. Moreover the operations for modifying the programming of the lock, which are to be effected by the user, are of the maximum simplicity and, at the same time, offer the maximum safety. The structure of the lock allows the provision of a great number of different keys. Moreover the lock has a great resistance, notwithstanding the unavoidable delicacy of the inner mechanisms. In order to obtain a special resistance to the attempts of violating the lock by means of a drill or similar tool, it is possible to insert in rotor 9 some pins of very hard material, as those shown at 49.

It is to be realized that the invention is not limited to the embodiment which has been described and shown as an example. Some possible changes have been stated, and others are available to those skilled in the art. In particular, in the lock stator there may be provided a single groove intended to co-operate both with the stop bar and with the translation bar, as described and shown, but also two or more grooves could be foreseen, arranged according to different angles, in order to obtain one or more position of key change situated in various positions. These modifications and others, as well as any replacement by technically equivalent means, may be introduced without departing from the scope of the invention as stated in the appended Claims.

I claim:

1. A programmable cylinder lock, comprising:

a stator with a cavity therein;

a rotor in said cavity and having a keyhole;

at least one combination of a first locking pin and a first counter-pin extending across an interface between said stator and said rotor for allowing rotation of said rotor in said cavity when a boundary between said first locking pin and said first counter-pin aligns with said interface, one of said first locking pin and said first counter-pin being divided into two or more sections so that more than one position of said combination across said interface allows rotation of said rotor in said cavity; and a programming mechanism comprising, in said stator, at least one longitudinally extending groove in said cavity, a set of stator seats and locking counter-pins and springs in said stator seats, and, in said rotor, a set of first seats which intersect said keyhole, a set of second seats parallel to said first seats, a first slit and a second slit perpendicular to said first and second seats and parallel to an axis of said rotor, a set of key followers longitudinally and transversely movable within said first seats, each of said key followers having on one edge a number of first projections and on an opposite edge a slidable joint member and having an associated spring, a set of second locking pins slidably inserted in said second seats corresponding to said locking counter-pins and having a number of first recesses facing said first projections of said key followers and one or more second recesses directed opposite said key followers, a stop bar in said first slit and having second projections facing said second recesses of said second locking pins and an uninterrupted third projection extending in an opposite direction for co-operating with said longitudinally extending groove, first springs urging said stop bar outwardly, a translation bar in said second slit and having slidable joint members for engaging said slidable joint members and an uninterrupted fourth projection extending in an opposite direction for co-operating with said longitudinally extending groove, and second springs urging said translation bar outwardly.

2. The lock as set forth in claim 1, comprising a plurality of said combinations of said locking pin and said counter-pin.

3. The lock as set forth in claim 1, further comprising at least one combination of a third locking pin and a second counter-pin that are not divided into sections.

4. The lock as set forth in claim 1, comprising a plurality of said first locking pins.

5. The lock as set forth in claim 1, further comprises an elastic fork-shaped ring in said stator and co-operating with said rotor to limit a size of said keyhole only during reprogramming, whereby only specific keys having a reduced shape are allowed to be taken out from the keyhole when re-programming the lock.

6. The lock as set forth in claim 1, further comprising pins of very hard material inserted in the lock rotor in order to prevent its effraction by means of drilling tools.

* * * * *